US007036534B2

(12) United States Patent
McClure

(10) Patent No.: US 7,036,534 B2
(45) Date of Patent: May 2, 2006

(54) MARINE ENGINE CORROSION PREVENTION SYSTEM

(76) Inventor: Thomas W. McClure, 2815 Lancaster Ct., Brookfield, WI (US) 53045

( * ) Notice: Subject to any disclaimer, the term of this patent is extended or adjusted under 35 U.S.C. 154(b) by 0 days.

(21) Appl. No.: 10/675,578

(22) Filed: Sep. 30, 2003

(65) Prior Publication Data

US 2005/0067045 A1 Mar. 31, 2005

(51) Int. Cl.
*B65B 1/04* (2006.01)

(52) U.S. Cl. ..... 141/9; 141/85; 141/89; 141/91; 141/63; 422/10

(58) Field of Classification Search ..... 141/4–9, 141/85–91, 98, 11, 63; 123/41.14, 41.3; 422/9, 10, 40
See application file for complete search history.

(56) References Cited

U.S. PATENT DOCUMENTS

| | | | | |
|---|---|---|---|---|
| 1,817,714 | A | 8/1931 | Shand | |
| 2,939,437 | A | 6/1960 | Barker | |
| 3,188,166 | A | 6/1965 | Dietz et al. | |
| 5,239,858 | A * | 8/1993 | Rogers et al. | 73/40.7 |
| 5,524,681 | A | 6/1996 | Davies et al. | |
| 6,230,669 | B1 * | 5/2001 | Evans | 123/41.5 |
| 6,579,136 | B1 | 6/2003 | Hahn et al. | |
| 6,698,389 | B1 * | 3/2004 | Andrews et al. | 123/41.31 |
| 2003/0114053 | A1 | 6/2003 | Hahn et al. | |

* cited by examiner

*Primary Examiner*—Timothy L. Maust
(74) *Attorney, Agent, or Firm*—Ryan Kromholz & Manion, S.C.

(57) ABSTRACT

An apparatus and method for prevention of corrosion with the cooling system of an internal combustion engine is disclosed. The apparatus includes a pressurized inert gas source and a fluid delivery system whereby the gas is dispersed within the cooling system to expel corrosion inducing fluids such as oxygen and water vapor. Methods of use are also disclosed.

4 Claims, 3 Drawing Sheets

MARINE ENGINE CORROSION PREVENTION SYSTEM

BACKGROUND OF THE INVENTION

The present invention relates to an apparatus and method for inhibiting corrosion, and more particularly to a new and improved apparatus and method that prevents the corroding of cooling fluid passageways and other surfaces of internal combustion engines during storage or prolonged periods of non-use. This is accomplished by removing substantially all of the oxygen and/or water vapor from the passageways and surfaces.

Internal combustion engines generate power by controlling multiple, successive explosions of a combustible fuel within one or more combustion chambers. The process generates not only power through the power take off component of the engine, but also heat. The heat generated during the process must be dissipated from the engine to avoid catastrophic failure of the engine or its components. Smaller engines typically dissipate heat through the flow of air across the engine. Air-cooled engines include cooling fins to increase the efficiency of the cooling process. This is commonly referred to as convection cooling. Engines used in the lawn and garden industry to provide power for lawn mowers, snow throwers, chain saws, etc. are commonly air-cooled.

Larger engines utilize a liquid fluid, such as water or water in combination with other ingredients for cooling purposes. Specifically, these larger engines include one or more fluid-tight passageways located within the engine and around the exterior of the engine to serve this purpose. Since the majority of the heat is produced in the combustion chambers, the majority of passageways are formed about this area of the engine. This structure is sometimes referred to as the water jacket.

Liquid fluid cooled engines can be further classified into two categories: closed loop systems and open loop systems. Closed loop systems circulate a predetermined amount of liquid fluid through the engine and a heat exchanger, such as a radiator. A pump is provided to circulate the liquid fluid. The fluid is commonly referred to as coolant. The fluid absorbs the excess heat around the combustion chamber (and elsewhere) of the engine and then dissipates or cools the fluid in the heat exchanger. As the system is closed, no new or additional fluid is added or removed from the system during cooling (i.e. engine operation).

An open loop system also includes a pump, but by contrast the open loop system draws the cooling fluid from a fluid source, circulates the fluid through the cooling system and then expels the fluid back to the source. This type of cooling system is commonly used on marine engines such as outboard engines, inboard engines and inboard/outboard engines. In the case of a marine engine, the cooling fluid comprises the body of water within which the boat utilizing the engine is situated. A common problem with an open loop cooling system is that the cooling fluid (i.e. water) includes all of the contaminants and corrosive components that exist in the fluid. For example, a marine engine operating in a salt-water environment is subject to the corrosive nature of the salt that accumulates in its cooling system.

The corrosive nature of salt in marine engines can ultimately lead to destruction and/or catastrophic failure of the engine after prolonged exposure to salt. To combat this problem, boat owners and operators typically "flush" their cooling systems by providing a fresh water supply at the engine's cooling fluid intake and operating the engine for a predetermined amount of time to flush the salt water and residual salt from the cooling system. It is desirable to flush an engine as soon as possible after operation in a salt-water environment so that the corrosive salts can be immediately removed. It is imperative that the salts be removed before the salt water cools and dries within the cooling system thereby forming salt crystals within the passageways and on the interior surfaces of the engine cooling system. A galvanic corrosive reaction occurs between the salts, oxygen, water vapor and metal engine components. If not terminated, the corrosion will continue leading to the ultimate destruction of the engine component or a portion thereof.

With respect to marine engines, it is known in the art to elevate a boat on a lift after operation in a salt water environment, connect a fresh water source to the cooling system intake and operate the engine for a sufficient time period in an attempt to remove all salt water and residual salt from the cooling system. Depending upon the specific type or style of marine engine, many companies manufacture devices that can be easily and temporarily coupled to the engine's water intake port. Such devices also include a coupling or fitting that is connected to a garden hose or similar supply line. The opposite end of the hose is connected to the fresh water source.

While this method and apparatus can also be used for marine engines that are still submersed in salt water, the removal of salts from the cooling system is much less effective as salt water is likely to leak into the cooling system during flushing as well as upon completion of the flushing process.

While this common flushing process is generally accepted as the best remedy for the removal of salt water from the engine's cooling system, it is known that the process does not remove all salt from the system. The flow of fluid through the cooling system is often such that there exist pockets or areas where the fresh water is either not circulated or not circulated in sufficient quantities to remove all of the salt. As a result, at some point in time the marine engine will be damaged or fail due to corrosion.

Additional drawbacks to the accepted method of flushing include the necessity of removing the boat from the water on a lift or rack, accessibility to a plentiful fresh water source, the necessity of operating the marine engine during the flushing process and the amount of time it takes to complete the flushing process.

Another known flushing system for marine engines is disclosed in U.S. Pat. No. 6,579,136 to Hahn, et al. This system includes a reservoir, a dispenser and a connection device. The reservoir is filled with a protective liquid fluid that includes anticorrosive properties. The dispenser allows for controlled release of the protective liquid fluid directly into the engine's cooling system downstream of the engine's water intake. The boat operator can release the protective fluid into the cooling system as needed (i.e. prior to storage of the boat).

SUMMARY OF THE INVENTION

The general purpose of the present invention is therefore to provide a corrosion inhibiting apparatus and method which are easy to practice, and which will effectively reduce the tendency of corrosion to accumulate upon the inaccessible surfaces and passageways of an internal combustion engine cooling system. The method has been design to be relatively simple and short, while obviating the difficulties encountered in the practice of prior art processes. To attain this, the present invention contemplates an apparatus for the introduction of an inert gas into the interior cooling system or water jacket of an internal combustion engine, typically somewhere near the highest point of the cooling system. The process is continued by allowing the inert gas to circulate throughout the entire cooling system until all corrosion inducing fluids, such as oxygen and water vapor are expelled through the engine's cooling system intake and exhaust output ports. Finally the inert gas is retained in the system for the length of time it is desired to preserve the cooling system. In addition, an anticorrosive material may be mixed with the inert gas prior to introduction to increase the efficacy of the system. By using an inert gas that is lighter than air, oxygen and water vapor, all of the key elements critical to corrosion are displaced from the system due to the density of the purging fluid (i.e. inert gas).

The apparatus includes a source of inert gas, a pressure regulator, a valve and a connector. All four components are fluidly coupled in series through a suitable conduit or hose. A mating connector is attached to the engine cooling system, again ideally near an uppermost portion of the engines cooling system. The mating connector may remain permanently connected to the engine. The apparatus connector is connected to the mating engine connector after the engine has been stopped. After the pressure regulator has been properly adjusted, the valve is opened for a predetermined period of time to permit the inert gas to flow and fill the cooling system. During the filling process, all oxygen and water vapor are dispelled or forced out of the system through either the intake or output ports. In an alternate embodiment, a source of anticorrosive material is provided along with a mixing device to combine the inert gas and anticorrosive material prior to the introduction of the mixed compound into the engine.

As used in the present application, an inert gas should be understood to include a gaseous fluid that is non-reactive with fluids within the engines cooling system or an inert gaseous fluid other than oxygen and hydrogen and ideally is a gaseous fluid that has a density less than that of oxygen and water vapor. The preferred inert gas is helium. The amount of helium required to purge the cooling system of oxygen and water vapor is significantly less than other inert gases due to helium's low density and hence its natural buoyancy in comparison to air. Helium also prevents the possibility of air leakage back into a watertight system. Another suitable non-reactive gas is nitrogen, which would be considered an inert gas according to the present invention. However the use of nitrogen would require a greater quantity to be introduced into the cooling system due to the fact that nitrogen has a density only slightly less than that of air. In addition, the inert gas may also include those gases or gaseous compounds that are chemically non-reactive with the compounds within the cooling system, such as argon or Freon. Because these inert gases have a density greater than that of air, these gases must be introduced from the bottom of the engine cooling system or combustion chamber. It is to be specifically noted that this reverse purging method falls within the scope of the present invention.

The anticorrosive material can comprise a lubricant or a biodegradable material. Suitable lubricants include commercially available fogging oil. Vegetable oil may also be used as a biodegradable anticorrosive material.

It is important to note that because an inert gas is utilized in the preferred embodiment of the invention, the system may be used at any time after engine shut down. Unlike the prior art processes, the engine need not be in operation during introduction of the inert gas. Because the preferred gas is non-reactive or inert, the gas can be introduced into a hot engine (i.e. there is no need to wait for the engine to cool before introduction of the inert gas into the cooling system). The apparatus and method of the present invention may be used on a marine engine that is in the water, on a marine engine that has been removed from the water or on any other fluid cooled engine.

An object of the present invention is to provide a corrosion inhibiting apparatus and method in which the potential for galvanic corrosion is chemically terminated, so as to prevent the accumulation of corrosion within the interior of an internal combustion engine cooling system.

Another object of the present invention is to provide a corrosion inhibiting process in which all water, oxygen, salts, and other corrosion causing materials are removed from the cooling system of an internal combustion engine by the introduction of an inert non-corrosive gaseous fluid.

A further object is to provide a strategically placed and easily accessible coupling within the cooling system for introduction of the buoyant, inert gas into the cooling system.

Another object of the invention is to provide an apparatus that can provide the inert gas for a predetermined period of time or in a predetermined quantity.

A still further object of the invention is to provide dual protection from corrosion for the cooling system of an internal combustion engine by providing an anticorrosive protective film coating for the cooling system while retaining an atmosphere of inert gas.

Other objects and advantages of the invention will hereinafter become more fully apparent from the following description of the drawings, which illustrate a preferred embodiment of the apparatus by which the present invention may be practiced.

DESCRIPTION OF THE PREFERRED EMBODIMENT

Although the disclosure hereof is detailed and exact to enable those skilled in the art to practice the invention, the physical embodiments herein disclosed merely exemplify the invention that may be embodied in other specific structures. While the preferred embodiment has been described, the details may be changed without departing from the invention, which is defined by the claims.

Figure 1:
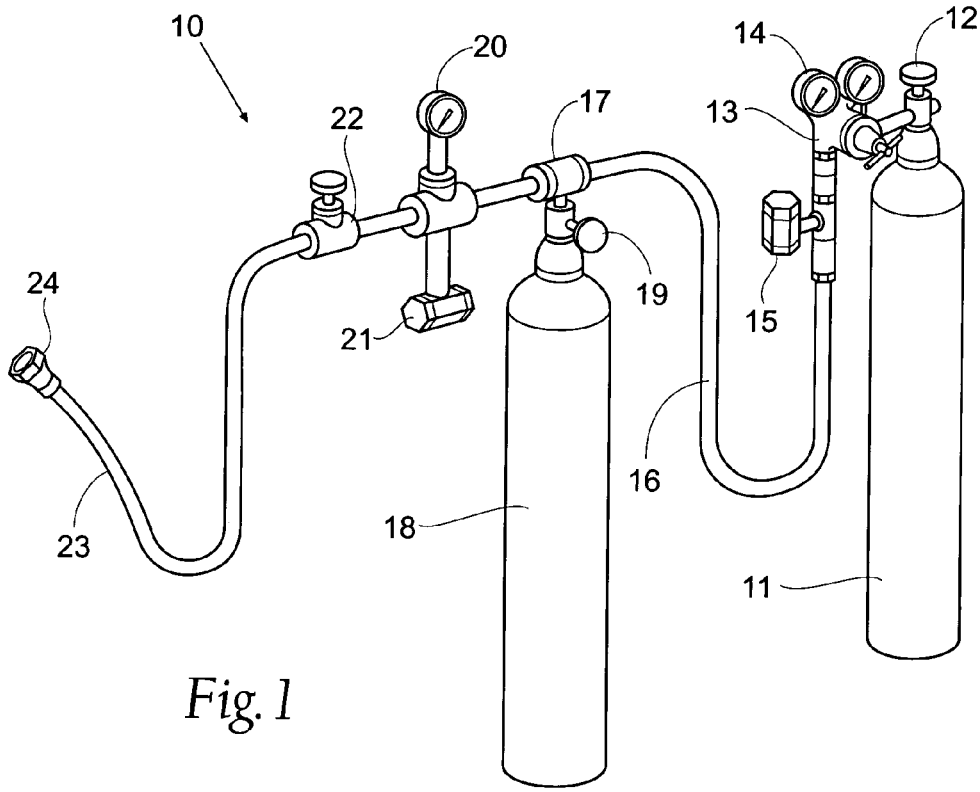
FIG. 1 is a perspective view of the corrosion prevention system.

Referring now to FIG. 1, reference numeral 10 is used to indicate the apparatus of the present invention. The first component includes a cylindrically shaped tank 11 containing a supply of inert gas, or a gas that is non-reactive with the fluids within tank 11. Preferred inert or non-reactive gases for the purpose of the present invention include helium and nitrogen. The inert gas is retained within tank 11 under high pressure, and when it is desired to use the apparatus, valve 12 is opened to introduce a supply of gas into the system herein after described. A conventional pressure regulator 13, having the usual pressure gauge 14, is provided in the system 10 adjacent tank 11, and is adapted to control and limit the pressure of the inert gas to a maximum level, such as, for example, 100 pounds per square inch (psi). In order to work effectively, the inert gas flow must be regulated to gradually displace all corrosion inducing fluids in the cooling system without creating an undue pressure buildup in the cooling system. A relief valve 15, which is actuatable at a set predetermined pressure such as 120 psi, is provided in the system 10 adjacent regulator 13 to act as a safety device. A flexible hose 16 extends from relief valve 15 to a pressure gas jet eductor 17 connected to an anticorrosive material tank 18, which is adapted to be mixed in its venturi (not shown) with the supply of inert gas from the tank 11. When the valve 19 of tank 18 is opened, the high velocity inert gas atomizes the liquid withdrawn from the anticorrosive material tank 18 into the venturi and creates an anticorrosive protective film coating or "fog" for coating the internal surfaces of the cooling system. A pressure gauge 20 is connected in the system adjacent tank 18, and is suitably provided with a pressure relief valve 21. A shut-off valve 22 is provided in the system 10 adjacent gauge 20, and is connected by a flexible hose 23 to a high pressure quick connect coupling or fitting 24 utilized to convey the inert gas and anticorrosive material through a mating cooling system coupling 25 attached to the cooling system 26 of an engine 33 to be preserved (see FIG. 4).

Figure 2:
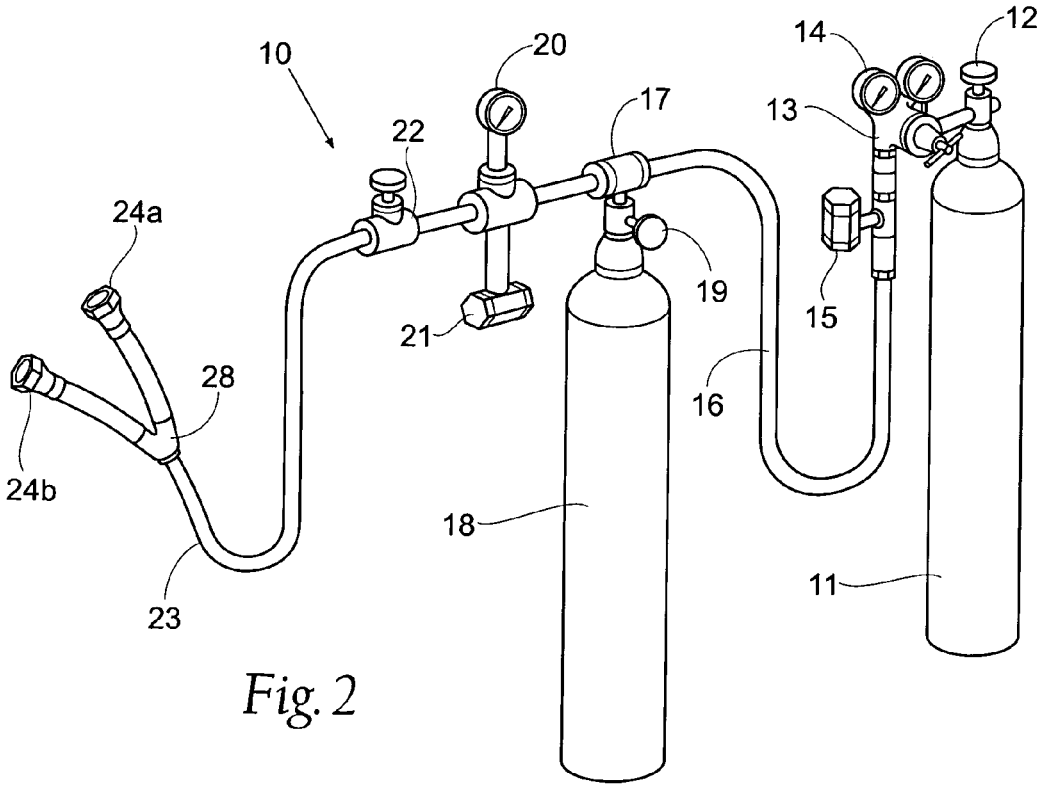
FIG. 2 is a perspective view of an alternative system.

In an alternate embodiment shown in FIG. 2, a "Y" fitting 28 may be provided in flexible hose 23 to allow the system 10 to be provided with two outlet couplings 24*a* and 24*b*. This arrangement is best used for an engine having two cylinder banks or heads (not shown).

Figure 3:
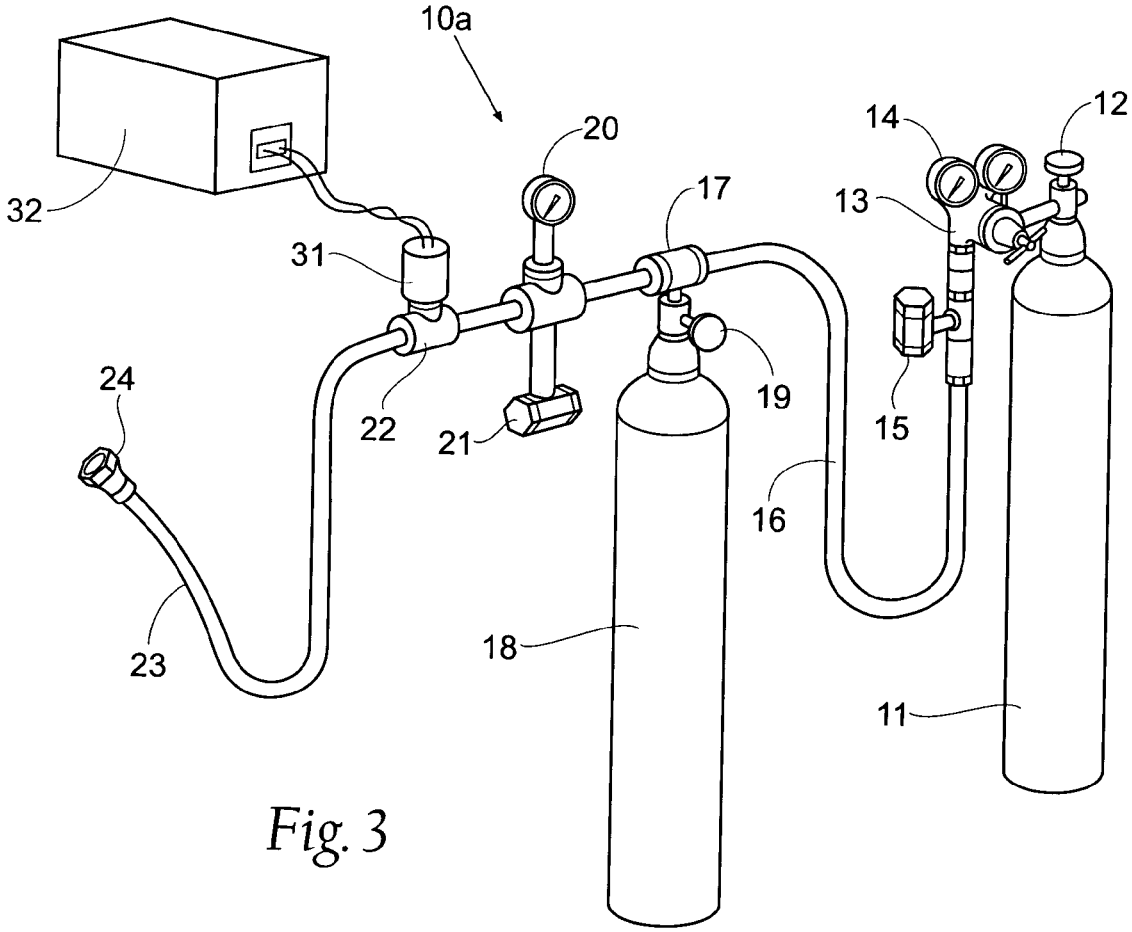
FIG. 3 is a perspective view of another alternative system.

In yet an another embodiment, designated 10*a* and as shown in FIG. 3, the handle of valve 22 may be replaced with a solenoid 31 connected to a programmable controller 32 for automatically dispensing the inert gas contained within tank 11 and corrosion inhibitor contained within tank 18 into the engine cooling system 26. The controller 32 may further include a timer (not shown) that can be programmed to allow the inert gas and anticorrosion material to be dispensed for a predetermined time period. In addition or alternatively, the timer may be programmed to dispense inert gas and anticorrosion material at a predetermined time or at predetermined time intervals. The valve 22 may also include a flow meter (not shown) connected to the controller 32 that can be programmed to dispense a predetermined amount of inert gas through the system 10*a*.

Figure 4:
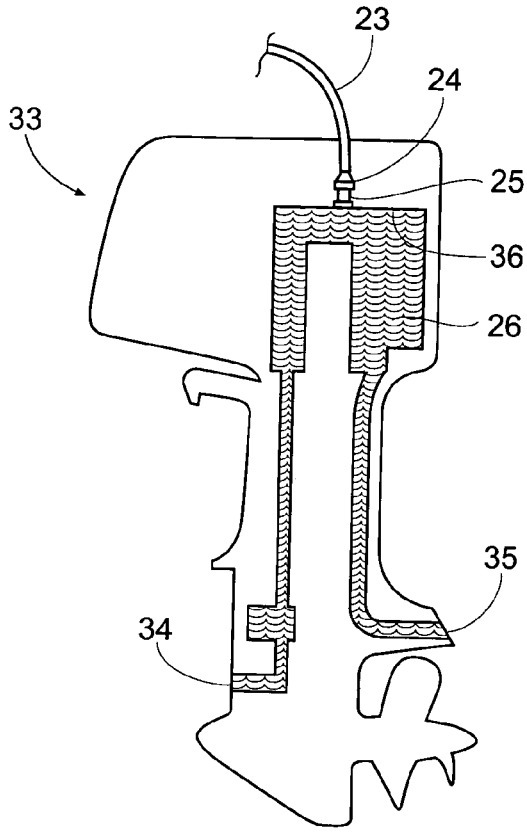
FIG. 4 is a view of the system connected to an outboard marine engine.

FIG. 4 shows the system 10 or 10*a* connected to a marine outboard engine 33. The present invention has a further advantage in its application to an outboard marine engine 33 in that the inert gas may be easily introduced into the interior of the engine cooling system 26 at the top of the engine 36. As shown quick disconnect coupling member 25 is in fluid communication with the cooling system 26 of the engine 33. The quick disconnect coupling member 25 is of a type that is known in the art and that mates with the coupling member 24 attached to the distal end of hose 23 in the apparatus 10. When coupling 24 and coupling 25 are connected, a fluid tight connection is formed. While it is preferred that the coupling member 25 in fluid communication with the engine's cooling system remain in the engine once installed, the coupling 25 could be removed and replaced with a plug (not shown).

The coupling 25 could be placed anywhere in the cooling system 26, however it is desirable to place the coupling at the highest point of the cooling system 26 as shown. This allows the inert gas to dispel all fluids containing corrosion-inducing materials such as oxygen and water vapor to the bottom of the cooling system where they are dispelled through the cooling system intake 34 and the exhaust output 35.

The method of the present invention includes the steps of installing a coupling in fluid communication with the cooling system of an engine, connecting a source of pressurized inert gas to the coupling and dispensing a predetermined amount of gas into the cooling system.

The preferred inert or non-reactive gases include helium and nitrogen. Alternate inert gases or gaseous compounds include argon and Freon. The preferred inert gas should have a density that is less than the density of corrosion inducing materials that are sought to be purged from the cooling system such as oxygen and/or water vapor and should be introduced into an upper portion of the engine. When the inert gas is introduced into the cooling system 26 of an internal combustion engine, the gas will quickly become dispersed throughout the entire cooling system 26 of the engine and will displace air (including oxygen) and water vapor residing within the cooling system 26. While the inert gas will initially rise to the top or uppermost portion 36 of the cooling system 26, as the volume of gas increases and accumulates within the system the inert gas will force the oxygen and water vapor out of the system through the cooling system openings including the water intake 34 and exhaust outlet 35. By removing the oxygen and water vapor from the system 26, the potential for the formation of corrosion within the cooling system is also eliminated.

Alternatively, an inert gas that has a density greater than that of air can also be utilized. However, it is preferable that these inert gases be introduced into a lower portion of the engine cooling system.

Figure 5:
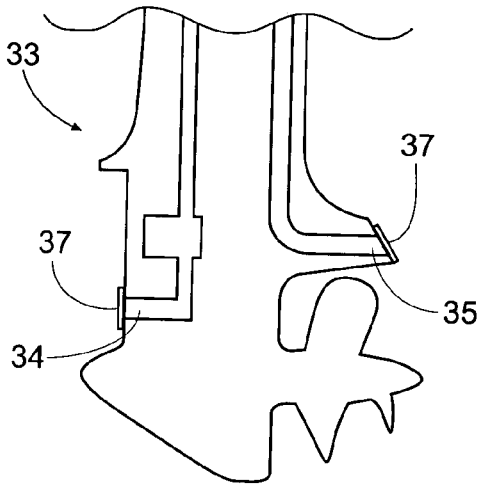
FIG. 5 is an exploded, partial view of the marine outboard engine.
Figure 6:
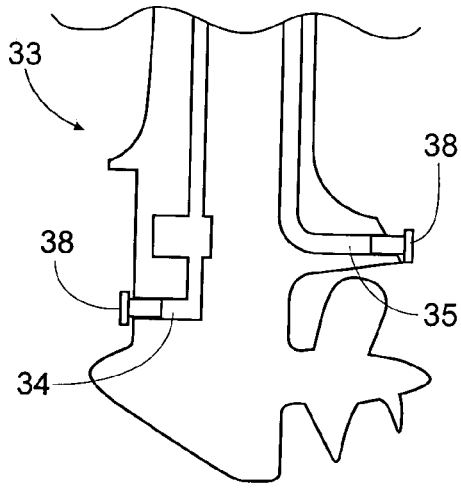
FIG. 6 is another exploded, partial view of the marine outboard engine.

As shown in FIG. 5, for long periods of storage, the cooling system intake port 34 and exhaust port 35 of the engine 33 can be suitably sealed with adhesive tape 37 (or a similar material) to retain the corrosion inhibiting atmosphere of inert gas within the interior of the engine cooling system. Alternatively, and as shown in FIG. 6, conventional plugs 38 can be installed in the intake port, 34 and exhaust port 35. It is also contemplated that the inert gas could be reintroduced to the engine cooling system at a later time during a prolonged storage period. Utilizing the controller 32 in conjunction with solenoid valve 31, this may be accomplished automatically.

De-preservation of the engine preserved by the present apparatus and method is accomplished by merely starting the engine in the water to flush the inert gas from the cooling system.

The apparatus and method set forth above can be applied to all types of engines that may be stored for prolonged periods of time including engines that have closed loop cooling systems such as automobile, truck and aircraft engines. The inert gas would be dispelled into the coolant inlet of the engine while oxygen and water vapor would be expelled through the coolant outlet. Again, the inlet and outlet may be sealed after the introduction of inert gas is complete to retain the inert gas environment within the cooling system. In addition, many modifications and variations of the present invention are possible in the light of the above disclosure. Anyone skilled in the art of preserving machinery can readily see that this method could equally preserve tanks, heat exchangers, compressors, pumps, turbines and other types of process equipment or the like.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A method of inhibiting corrosion on the interior surfaces of an internal combustion engine cooling system during storage comprising the steps of:

coupling in a fluid tight mating fashion a source of pressurized inert gas to an intake port formed in said engine;

dispersing said inert gas into said engine cooling system through said intake port formed in said engine; and purging corrosion producing fluids from said engine as said inert gas is dispersed into said engine.

2. The method of claim 1 further including the step of retaining said inert gas in said engine whereby corrosion on said internal surfaces is prevented.

3. The product of the method of claim 1.

4. A method of inhibiting corrosion on the interior surfaces of an internal combustion engine cooling system during storage comprising the steps of:

coupling in a fluid tight mating fashion a source of pressurized helium gas to an intake port formed in said engine;

dispersing said helium gas into said engine cooling system through said intake port formed in said engine; and purging corrosion producing fluids from said engine as said helium gas is dispersed into said engine.

* * * * *